US009976447B2

(12) United States Patent
Chrabascz et al.

(10) Patent No.: US 9,976,447 B2
(45) Date of Patent: May 22, 2018

(54) TURBINE HOUSING FOR AIR CYCLE MACHINE

(75) Inventors: Eric Chrabascz, Longmeadow, MA (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1678 days.

(21) Appl. No.: 13/559,976

(22) Filed: Jul. 27, 2012

(65) Prior Publication Data

US 2014/0030080 A1 Jan. 30, 2014

(51) Int. Cl.
*F01D 9/02* (2006.01)
*F01D 25/24* (2006.01)
*F01D 25/28* (2006.01)

(52) U.S. Cl.
CPC ..... *F01D 25/285* (2013.01); *F05D 2220/10* (2013.01); *F05D 2230/72* (2013.01)

(58) Field of Classification Search
CPC ..... F02B 37/025; F02C 7/20
USPC ..... 415/205, 212.1, 213.1, 214.1
See application file for complete search history.

(56) References Cited

U.S. PATENT DOCUMENTS 2,492,672 A * 12/1949 Wood ..... 417/372
3,428,242 A * 2/1969 Rannenberg ..... 415/180
4,507,939 A 4/1985 Wieland
5,109,756 A 5/1992 Barboza et al.
5,224,842 A 7/1993 Dziorny et al.
5,249,934 A * 10/1993 Merritt et al. ..... 417/406
5,309,735 A 5/1994 Maher, Jr. et al.
5,921,683 A 7/1999 Merritt et al.
5,924,922 A 7/1999 Eakin et al.
6,090,175 A 7/2000 Richard
6,409,483 B2 * 6/2002 Jinnai ..... 417/407
6,615,606 B2 9/2003 Zywiak
7,251,951 B2 8/2007 McBride et al.
7,402,020 B2 7/2008 Beers et al.
7,757,502 B2 7/2010 Merritt et al.
7,779,644 B2 8/2010 Decrisantis et al.
2006/0059942 A1 3/2006 McAuliffe et al.
2007/0134105 A1 6/2007 Beers et al.
2011/0192165 A1 * 8/2011 Rosen et al. ..... 60/698

FOREIGN PATENT DOCUMENTS

CN 102530253 7/2012
FR 2897893 A1 * 8/2007 ..... F01N 7/10

* cited by examiner

*Primary Examiner* — Sean J Younger
(74) *Attorney, Agent, or Firm* — Carlson, Gaskey & Olds, P.C.

(57) ABSTRACT

A turbine inlet housing has a main housing body extending about a central axis. An inlet duct delivers air into a cavity within the main housing body. Bolt hole bosses are formed on a downstream face of the inlet housing to receive bolts to secure an outlet housing to the inlet housing. A plurality of the bosses have a ramped surface which extends radially outwardly for a greater extent than a second plurality of bosses. The plurality of ramped bosses extend between the downstream face and the duct. The ramped bosses have a forward boss portion, and a ramped surface at an angle of between 50 and 54 degrees extending from an upstream end of the forward boss portion. A curved surface curves from an upstream end of the ramped surface to merge into the duct. A turbine stage and air cycle machine are also disclosed and claimed.

3 Claims, 3 Drawing Sheets

TURBINE HOUSING FOR AIR CYCLE MACHINE

BACKGROUND

This application relates to a unique turbine housing which will be incorporated into an air cycle machine.

Air cycle machines are known, and typically include a pair of turbine stages mounted at opposed ends of the machine, and driving a common shaft. A compressor is mounted intermediate the two turbines, and it is driven by the turbines along with the shaft.

Typically, the turbines may be exposed to ram air, such as may be found outside a moving aircraft. The air is delivered into a first turbine stage, driving that turbine stage to rotate, and then the air passes downstream to a second turbine stage.

The compressor compresses air which may be delivered for use in a cabin of the aircraft, or for other uses on the aircraft.

Housings are associated with each of the three sections.

SUMMARY

A turbine inlet housing for an air cycle machine has a main housing body which extends about a central axis, and is to receive a turbine rotor. An inlet duct extends away from the main housing body to provide an inlet duct for delivering air into a cavity within the main housing body. A plurality of bolt hole bosses are formed on a downstream face of the inlet housing. The bolt hole bosses will receive bolts to secure an outlet housing to the inlet housing. A plurality of the bosses have a ramped surface which extends radially outwardly for a greater extent than a second plurality of bosses. The plurality of ramped bosses extend between the downstream face and the duct. The ramped bosses have a forward boss portion, and a ramped surface at an angle of between 50 and 54 degrees extending from an upstream end of the forward boss portion. A curved surface curves from an upstream end of the ramped surface to merge into the duct. A turbine stage and air cycle machine are also disclosed and claimed.

These and other features of the invention will be better understood from the following specifications and drawings, the following of which is a brief description.

DETAILED DESCRIPTION

Figures 1, 2:
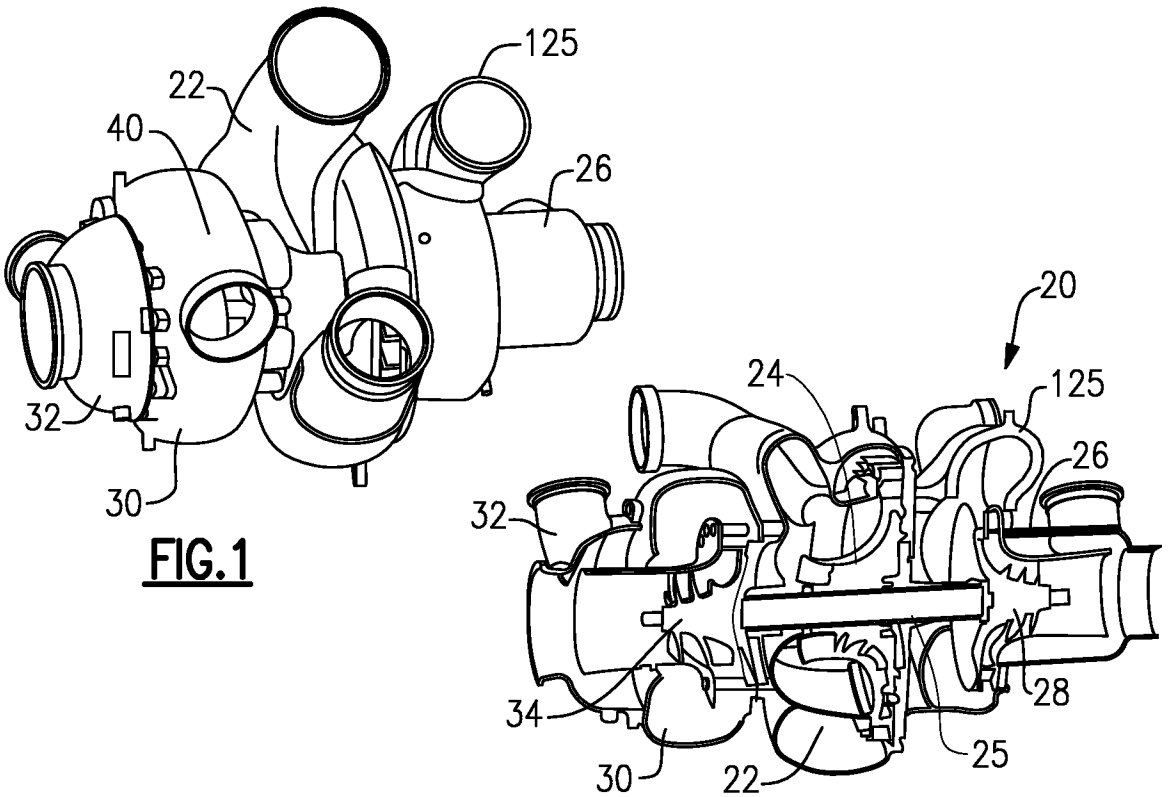
FIG. 1 shows an outside assembled air cycle machine.
FIG. 2 is a cross-sectional view through an air cycle machine.

An air cycle machine 20 is illustrated in FIGS. 1 and 2 having a compressor housing 22 housing a compressor rotor 24. The compressor rotor 24 is driven by a shaft 25. A high pressure turbine stage is provided by a pair of housings 125 and 26. The housings 125 and 26, in combination, house a turbine rotor 28, which drives the shaft 25.

A second stage turbine includes a rotor 34 enclosed between an inlet housing 30 and an outlet housing 32 that also drives shaft 25. Rotor 34 is housed in a cavity or chamber 104 within housing 30.

As shown, the inlet housing 30 includes a duct 40 that receives air downstream of the first turbine rotor 28. The inlet housing 30 could be said to be "upstream" of the outlet housing 32, in that air is received in the duct 40, passes across the second stage rotor 34, and leaves through the outlet housing 32.

Figure 3:
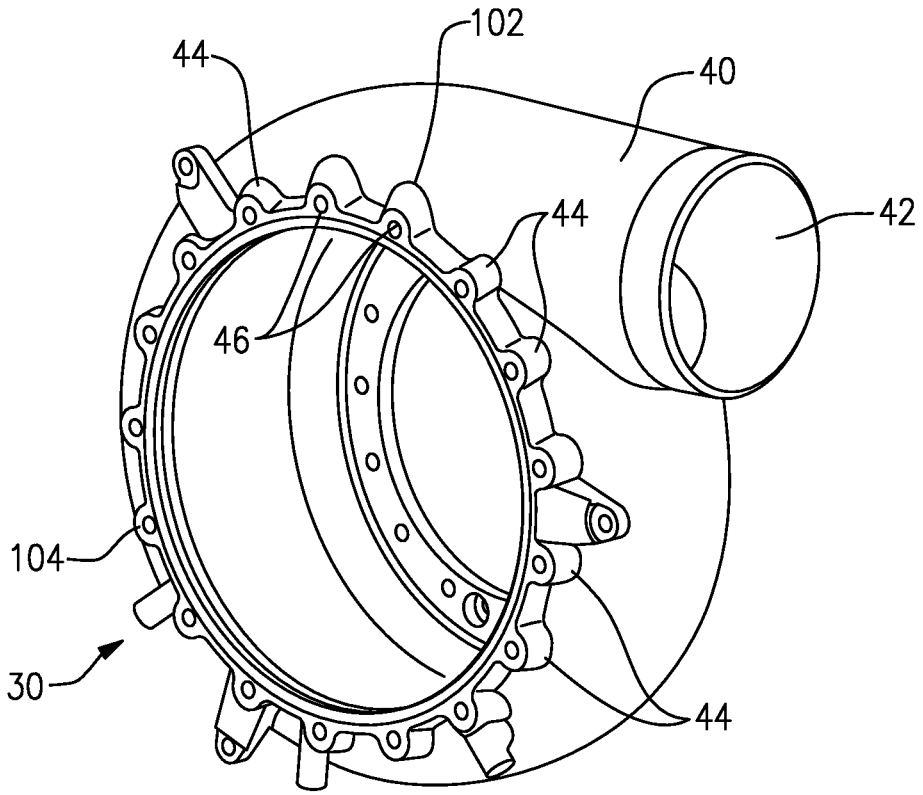
FIG. 3 shows a detail of a second stage turbine housing.

FIG. 3 shows the inlet housing 30. The duct 40 has an internal flow passage 42. A plurality of bosses 44 and 46 are provided to receive bolts to secure the housing 32 to the housing 30. In a sense, the bosses 44 and 46 can be said to be formed on a face 100 of the housing 30, which is "downstream" in that it is the face that connects to the outlet housing 32. As can be appreciated from FIG. 3, the bosses 44 are generally cylindrical, but bosses 46 associated with the duct 40 have a ramped radially outwardly extending surface, which will be better explained below. Bosses 46 extend to a point 102 where they merge into duct 40. This point 102 could be said to be upstream of downstream face 104.

Figure 4:
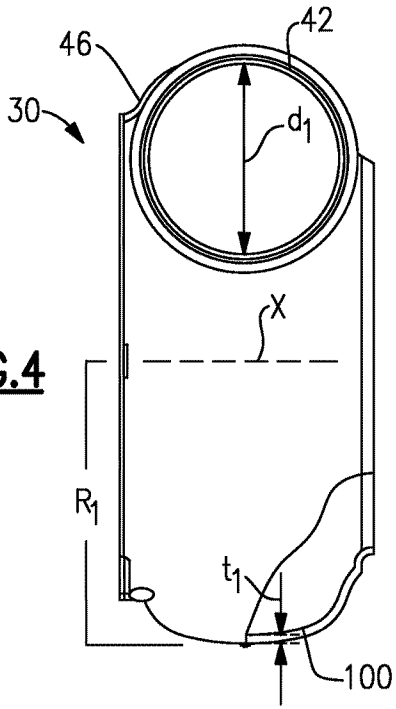
FIG. 4 is a front view of the FIG. 3 housing.

FIG. 4 shows details of the inlet housing 30. As shown, the duct 40 has a diameter $d_1$. A main housing portion has an inner radius $R_1$ from a center x that will be the rotational axis of the rotor 24. A wall 100 of the housing 30 has a thickness $t_1$. In embodiments, $d_1$ may be 4.75" (12.0 cm), $R_1$ 7.55" (19.1 cm), and $t_1$ 0.12" (0.30 cm).

Figure 5:
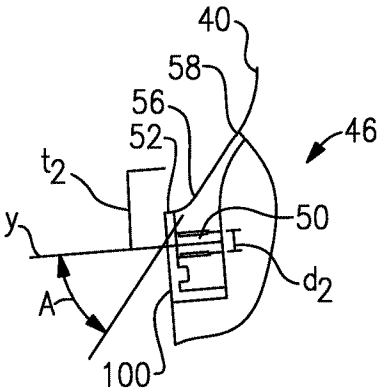
FIG. 5 shows a detail of the turbine housing.

As shown in FIG. 5, the ramped bosses 46 include a forward boss portion 52 receiving a bolt hole 50. A ramped surface 56 begins inwardly, or upstream of portion 52. Ramped surface 56 is at an angle A relative to a center y of the bolt hole 50. In one embodiment, A is 52 degrees. In embodiments, angle A was between 50 and 54 degrees. At a point 58, the angled surface ends and a curved ramp surface begins which merges into the duct 40.

The diameter of the bolt hole 50 is $d_2$. A distance $t_2$ is defined from the centerline y of bolt hole 50 radially outwardly to the end point 58 of the ramped surface 56. In embodiments, $t_2$ was 1.08" (2.74 cm), and $d_2$ was 0.25" (0.6 cm).

In embodiments, a ratio of $t_2$ to $d_2$ was between 4.2 and 4.4. A ratio of $t_2$ to $t_1$ was between 8.8 and 9.3. A ratio of $d_1$ to $t_1$ was between 39.3 and 39.8.

Figure 6:
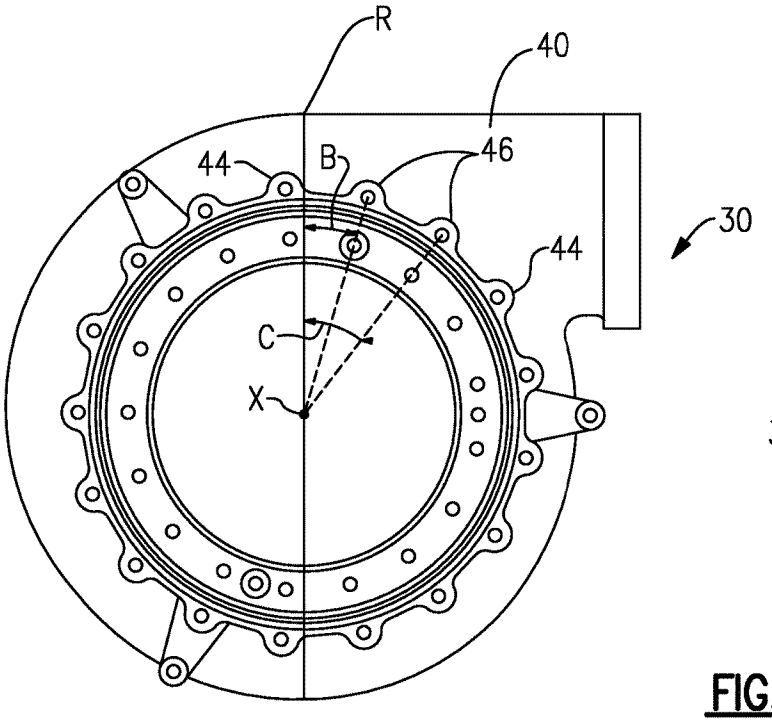
FIG. 6 shows another detail of the housing.

As shown in FIG. 6, there are 17 bosses 44/46 spaced circumferentially about the housing 30. The two ramped bosses 46 are defined as centered at angles B and C, relative to a radius T extending from a center x of the housing 30, and extending to be perpendicular to an outer surface of the duct 40. In one embodiment, B was 16.5 degrees and C was 37.7 degrees. In embodiments, B may be between 16.45 and 16.55 degrees, and C may be between 37.65 and 37.75 degrees.

A housing as disclosed above has beneficial features relative to the prior art. In particular, the ramped bosses operate to provide additional stability at highly stressed areas wherein the bolt holes 46 will be secured into the duct. The various geometries disclosed herein provide a housing which will be able to withstand the stresses, but also utilize a reduced amount of material.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine inlet housing for an air cycle machine comprising:

a main housing body extending about a central axis, and for receiving a turbine rotor, and an inlet duct extending away from said main housing body for delivering air into a cavity within said main housing body a downstream face of said main housing body for facing an outlet housing, and said duct being upstream of said downstream face;

a plurality of bolt hole bosses formed on said downstream face of said main housing body, said bolt hole bosses for receiving bolts to secure the outlet housing to said turbine inlet housing, and a first plurality of said plurality of said bosses having a ramped surface extending radially outwardly for a greater extent than a second plurality of said plurality of said bosses, and said first plurality of ramped bosses extending between said downstream face and said duct, and said ramped bosses having a forward boss portion, and a ramped surface at an angle of between 50 and 54 degrees extending from an upstream end of said forward boss portion, and a curved surface curving from an upstream end of said ramped surface to merge into said duct;

a ratio of a distance to the upstream end of said ramped surface being measured perpendicularly from said central axis to a diameter of a bolt hole formed in said ramped boss is between 4.2 and 4.4;

a ratio of a diameter of said duct to a thickness of a wall in said main housing body being between 39.3 and 39.8; and wherein a ratio of the distance to the upstream end of said ramped surface measured perpendicularly from said center axis to said thickness of said wall in said main housing body is between 8.8 and 9.3.

2. An air cycle machine comprising:

a first stage turbine rotor, a second stage turbine rotor, and a compressor rotor, said first and second stage turbine rotors being secured to drive a shaft, and said compressor rotor being secured to rotate with said shaft, and said compressor rotor being axially intermediate said first and second stage turbine rotors;

said first stage turbine rotor having a first stage housing, said compressor rotor having a compressor housing, said second stage turbine rotor having a second stage housing, with said second stage turbine rotor including an outlet housing which is bolted to an inlet housing; and said inlet housing having a main housing body extending about a central axis, and for receiving a turbine rotor, and an inlet duct extending away from said main housing body for delivering air into a cavity within said main housing body;

a downstream face of said main housing body facing said outlet housing, and said duct being upstream of said downstream face;

a plurality of bolt hole bosses formed on said downstream face of said main housing body, said bolt hole bosses receiving bolts to secure said outlet housing to said turbine inlet housing, and a first plurality of said plurality of said bosses having a ramped surface extending radially outwardly for a greater extent than a second plurality of said plurality of said bosses, and said first plurality of ramped bosses extending between said downstream face and said duct, and said ramped bosses having a forward boss portion, and a ramped surface at an angle of between 50 and 54 degrees extending from an upstream end of said forward boss portion, and a curved surface curving from an upstream end of said ramped surface to merge into said duct;

a ratio of a distance to the upstream end of said ramped surface being measured perpendicularly from said central axis to a diameter of a bolt hole formed in said ramped boss is between 4.2 and 4.4;

a ratio of a diameter of said duct to a thickness of a wall in said main housing body being between 39.3 and 39.8; and wherein a ratio of the distance to the upstream end of said ramped surface measured perpendicularly from said center axis to said thickness of said wall in said main housing body is between 8.8 and 9.3.

3. A second stage turbine for use in an air cycle machine comprising:

a turbine rotor received between an outlet housing and an inlet housing, said outlet housing and said inlet housing being connected by bolts;

said inlet housing having a main housing body extending about a central axis, and for receiving a turbine rotor, and an inlet duct extending away from said main housing body for delivering air into a cavity within said main housing body;

a downstream face of said main housing body for facing an outlet housing, and said duct being upstream of said downstream face;

a plurality of bolt hole bosses formed on said downstream face of said main housing body, said bolt hole bosses for receiving bolts to secure outlet housing to said turbine inlet housing, and a first plurality of said plurality of said bosses having a ramped surface extending radially outwardly for a greater extent than a second plurality of said plurality of said bosses, and said first plurality of ramped bosses extending between said downstream face and said duct, and said ramped bosses having a forward boss portion, and a ramped surface at an angle of between 50 and 54 degrees extending from an upstream end of said forward boss portion, and a curved surface curving from an upstream end of said ramped surface to merge into said duct;

a ratio of a distance to the upstream end of said ramped surface being measured perpendicularly from said central axis to a diameter of a bolt hole formed in said ramped boss is between 4.2 and 4.4;

a ratio of a diameter of said duct to a thickness of a wall in said main housing body being between 39.3 and 39.8; and wherein a ratio of the distance to the upstream end of said ramped surface measured perpendicularly from said center axis to said thickness of said wall in said main housing body is between 8.8 and 9.3.

* * * * *